US007591603B2

(12) United States Patent
Lofthus et al.

(10) Patent No.: US 7,591,603 B2
(45) Date of Patent: Sep. 22, 2009

(54) FACE-TO-FACE PRINTING WITHIN BOOKLET

(75) Inventors: Robert M. Lofthus, Webster, NY (US); Thomas M. Baretsky, Fairport, NY (US); Dusan Lysy, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 11/926,973

(22) Filed: Oct. 29, 2007

(65) Prior Publication Data

US 2008/0089710 A1 Apr. 17, 2008

Related U.S. Application Data

(60) Continuation of application No. 10/948,509, filed on Sep. 23, 2004, now abandoned, which is a division of application No. 10/382,615, filed on Mar. 5, 2003, now Pat. No. 6,814,004.

(51) Int. Cl.
*B41J 3/54* (2006.01)

(52) U.S. Cl. ..... 400/82; 400/149; 271/291

(58) Field of Classification Search ..... 400/82, 400/149, 150; 399/401, 405; 347/2, 104; 271/186, 291

See application file for complete search history.

(56) References Cited

U.S. PATENT DOCUMENTS 3,987,722 A 10/1976 Goodwin
4,116,558 A 9/1978 Adamek et al.
4,334,765 A 6/1982 Clark
4,384,782 A * 5/1983 Acquaviva ..... 399/373
4,493,482 A 1/1985 Valenti et al.
4,579,446 A 4/1986 Fujino et al.
4,814,822 A 3/1989 Acquaviva et al.
4,815,225 A 3/1989 Wilen
5,095,342 A 3/1992 Farrell et al.
5,105,283 A 4/1992 Forest et al.
5,142,340 A 8/1992 Farrell et al.
5,159,395 A 10/1992 Farrell et al.
5,337,135 A 8/1994 Malachowski et al.
5,377,965 A 1/1995 Mandel et al.
5,557,367 A * 9/1996 Yang et al. ..... 399/14
5,568,246 A 10/1996 Keller et al.
5,670,995 A * 9/1997 Kupcho et al. ..... 347/5
5,760,919 A 6/1998 Acquaviva et al.
5,839,045 A 11/1998 Wierszewski
5,848,345 A 12/1998 Stemmle
5,930,577 A 7/1999 Forsthoefel et al.
6,099,225 A 8/2000 Allen et al.
6,269,237 B1 * 7/2001 Olbrich et al. ..... 399/401
6,286,831 B1 * 9/2001 Marasco et al. ..... 271/303
6,317,581 B1 * 11/2001 Boehmer et al. ..... 399/401
6,397,023 B1 5/2002 Underwood et al.
6,550,762 B2 * 4/2003 Stoll ..... 271/186
6,681,085 B1 1/2004 Collard et al.

* cited by examiner

*Primary Examiner*—Ren Yan
(74) *Attorney, Agent, or Firm*—Fay Sharpe LLP

(57) ABSTRACT

Method for printing pages within a booklet to improve the appearance of images on opposing pages includes sequencing images such that opposing pages are printed with the same print engine and/or fused the same number of times. Booklets include opposing pages having images fused the same number of times and/or printed with the same print engine as the image on the opposing page.

11 Claims, 4 Drawing Sheets

FACE-TO-FACE PRINTING WITHIN BOOKLET

CROSS-REFERENCE TO RELATED APPLICATIONS

This is a continuation of U.S. application Ser. No. 10/948,509 filed Sep. 23, 2004 now abandoned, which is a divisional of U.S. application Ser. No. 10/382,615 filed Mar. 5, 2003, now U.S. Pat. No. 6,814,004 by the same inventors, and claims priority therefrom.

BACKGROUND AND SUMMARY

This invention relates generally to producing improved printing of face-to-face pages within a booklet and, more specifically, to a method for printing pages within a booklet to improve face-to-face appearance and the booklet produced thereby.

Customer acceptance of booklets assembled from duplex pages is sensitive to the consistency of appearance of opposing pages. Differences in color gamut, gloss, image size, and clarity are some of the problems encountered. Problems relating to cluster printing, that is, jobs assembled from separate machines include sheets with different gloss, color gamut, and image quality characteristics.

Tandem immediate duplex (xerographic) printers provide normal ordering of front sides on a first photoreceptor and back sides on a second photoreceptor, which also leads to similar problems. One example of such an apparatus is a tandem immediate duplex (color) xerographic (continuous) web printer. Another example is a tandem immediate duplex xerographic (cut sheet) printer, wherein images destined for the front sides of the physical sheets, i.e., the odd numbered pages, are imaged and developed sequentially on a first photoreceptor and images destined for the back sides of the physical sheets, i.e., the even numbered pages, are imaged and developed sequentially on a second photoreceptor. The physical sheets are fused twice; the first time in fuser #1 after transfer of the image on the front side of the sheet and the second time in fuser #2 after transfer of the image onto the back side of the sheet. Images on opposing pages have a different fused state and have been imaged/developed on different photoreceptor units. For example, an odd numbered page having an image developed on photoreceptor #1 that has been fused twice is opposed by an even numbered page having an image developed on photoreceptor #2 that has been fused only once.

Recirculating duplex printers having fusers present only the more subtle problem of differing fused state of opposing pages. This can lead to different gloss, different image shrinkage and/or misregistration of images. For example, a xerographic printer having a recirculating duplex paper path typically uses a fuser to fuse the image(s) to the paper. Images destined for the front sides of the physical sheets, i.e., the odd numbered pages, are imaged sequentially. After transfer of the first side image the physical page is inverted and recirculated. Images destined for the back sides of the physical sheets, i.e., the even numbered pages, are imaged sequentially. After transfer of the image destined for the back side, each physical page passes through the fuser again, bypasses the inverter and is stacked. The images on opposing pages in the stacker destined for a booklet have been fused a different number of times. For example, the image on page 14 has been fused once while the image opposing it, on page 15, has been fused twice.

A method in accordance with one embodiment includes producing a booklet from a multiple engine serial duplex printer, by:

ordering sequentially a first plurality of images on a first printing device;

feeding sequentially a plurality of two-sided sheets to the first printing device;

printing sequentially on one side of each of the plurality of two-sided sheets a corresponding one of the first plurality of images;

ordering sequentially a second plurality of images on a second printing device, such that when the second plurality of images is sequentially printed on a corresponding one of the other side of each of the plurality of two-sided sheets and alternate sheets in the sequence are inverted and stacked with alternate non-inverted sheets, images on opposing sides of the sheets are printed by the same printing device;

feeding sequentially the plurality of two-sided sheets to the second printing device;

printing sequentially on the other side of each of the plurality of two-sided sheets a corresponding one of the second plurality of images;

inverting alternated ones of the plurality of two-sided imaged sheets; and stacking sequentially the inverted sheets and non-inverted sheets, so that images on opposing sides of the sheets are printed by the same printing device.

A method in accordance with another embodiment includes producing a booklet from a multiple engine serial duplex printer, by:

ordering sequentially a first plurality of images on a first printing device;

feeding sequentially a plurality of two-sided sheets to the first printing device;

transferring sequentially on one side of each of the plurality of two-sided sheets a corresponding one of the first plurality of images;

fixing the image marked on each sheet;

ordering sequentially a second plurality of images on a second printing device, such that when the second plurality of images is sequentially fixed to a corresponding one of the other side of each of the plurality of two-sided sheets and alternate sheets in the sequence are inverted and stacked with alternate non-inverted sheets, images on opposing sides of the sheets are subject to the fixing process the same number of times and are printed by the same printing device;

feeding sequentially the plurality of two-sided sheets to the second printing device;

transferring sequentially on the other side of each of the plurality of two-sided sheets a corresponding one of the second plurality of images;

fixing the images marked on each sheet, the images corresponding to the first plurality images being fixed a second time and the images corresponding to the second plurality images being fixed a first time;

inverting alternated ones of the plurality of two-sided printed sheets; and stacking sequentially the inverted sheets and non-inverted sheets, so that images on opposing sides of the sheets are subject to the fixing process the same number of times and are printed by the same printing device.

A method in accordance with another embodiment includes producing a booklet from a recirculating duplex printer, by:

ordering sequentially a first plurality of images on a printing device;

feeding sequentially a plurality of two-sided sheets to the printing device;

transferring sequentially on one side of each of the plurality of two-sided sheets a corresponding one of the first plurality of images;

fixing the image marked on each sheet;

inverting sequentially a first pass of each one of the imaged plurality of two-sided sheets;

ordering sequentially a second plurality of images on the printing device, such that when the second plurality of images is sequentially fixed to a corresponding one of the other side of each of the plurality of two-sided sheets and alternate sheets on the second pass in the sequence are inverted and stacked with the alternate second pass non-inverted sheets, images on opposing sides of the sheets are subject to the fixing process the same number of times;

feeding sequentially the plurality of two-sided sheets to the printing device;

transferring sequentially on the other side of each of the plurality of two-sided sheets a corresponding one of the second plurality of images;

fixing the images marked on each sheet, the images corresponding to the first plurality images being fixed a second time and the images corresponding to the second plurality images being fixed a first time;

inverting alternate ones on the second pass of the plurality of two-sided printed sheets; and stacking sequentially the inverted sheets on the second pass and the non-inverted sheets on the second pass, so that images on opposing sides of the sheets have been subject to the fixing process the same number of times.

Another embodiment includes a booklet including a plurality of pages each having an image contained thereon wherein each image has been subject to a fixing process the same number of times as the image on an opposing page and wherein each image has been printed by the same printing device as the image on an opposing page.

Another embodiment includes a booklet including a plurality of pages each having an image printed thereon by a multiple engine serial duplex printer, wherein each image has been printed by the same printing device as the image on an opposing page.

DETAILED DESCRIPTION

Figure 1:
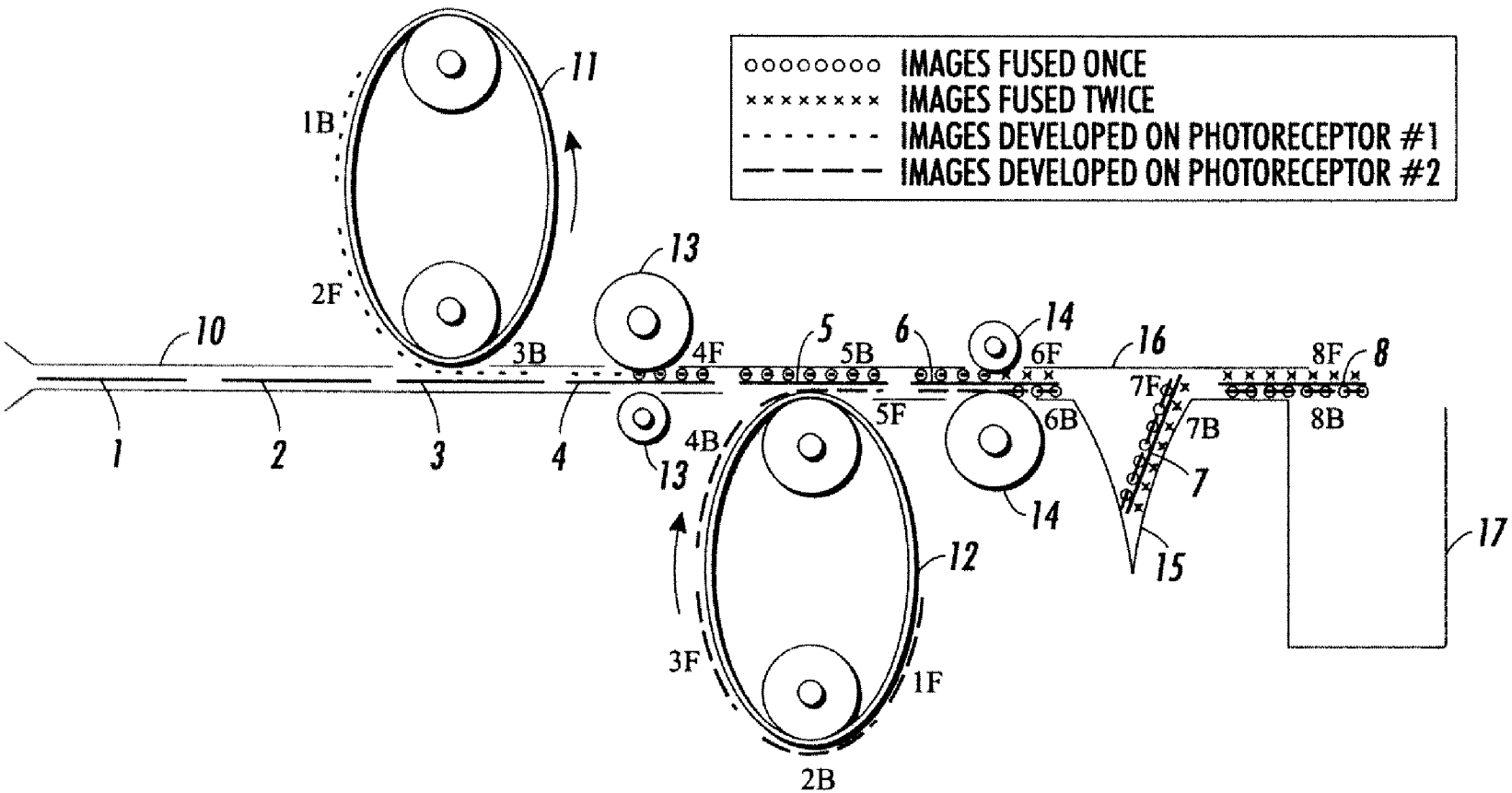
FIG. 1 is a schematic view of the paper path in a tandem duplex printer at an early moment in accordance with one embodiment.

The terminology "copiers", "copies", "printers", "prints", "imaging", "marking", and "printing" is used alternatively herein and refers to the entire process of putting an image (digital or analog source) onto paper. The image can be permanently fixed to the paper by fusing, drying, or other methods. It will be appreciated that the invention may apply to almost any system in which the images are made electronically, including electronic copiers.

Imaging systems (e.g., printers or copiers) typically include copy sheet paper paths through which copy sheets (e.g., plain paper) which are to receive an image are conveyed and imaged. The process of inserting copy sheets into the copy sheet paper path and controlling the movement of the copy sheets through the paper path to receive an image on one or both sides, is referred to as "scheduling". Copy sheets are printed by being passed through a copy sheet paper path (which includes a marking station) one or multiple times. Copy sheets which are printed on only one side (simplex copy sheets) in a single color usually pass through the copy sheet paper path a single time. Multipass printing is used to print images on both sides of a copy sheet (duplex printing), or to print a simplex sheet in multiple colors (one pass for each color). There are two general modes in which copy sheets to be multipass printed can be scheduled: "burst mode" and "interleave mode".

When scheduling in "burst mode", copy sheets are inserted into, imaged, and output from the copy sheet paper path without any "skipped pitches" existing between each consecutive copy sheet. A "pitch" is the portion (or length) of the copy sheet paper path in the process direction which is occupied by a copy sheet as it moves through the copy sheet paper path. A "skipped pitch" occurs when there is a space between two consecutively output copy sheets which is long enough to hold another copy sheet. Accordingly, when scheduling in "burst mode", copy sheets are output from the copy sheet paper path (and, thus, the imaging system) at a maximum rate because no skipped pitches exist between each consecutive copy sheet.

When scheduling copy sheets in "interleave mode", skipped pitches are provided between each consecutively scheduled copy sheet. That is, a space is provided between each copy sheet inserted into and output from the copy sheet paper path. While other copy sheets may be eventually inserted in the space between two consecutively input sheets, these other sheets are inserted at a later time and are thus "interleaved" with the previously inserted copy sheets.

Various methods for scheduling copy sheets are disclosed in, for example, U.S. Pat. Nos. 5,095,342; 5,159,395; and 5,557,367, which are incorporated herein by reference in their entirety.

This invention in embodiments thereof relates to a method for printing pages within a booklet to improve the appearance of images on opposing pages. In one embodiment this includes sequencing images such that opposing images are printed with the same print engine. In another embodiment, this includes sequencing images such that opposing images are fused the same number of times for uniformity of paper shrinkage and image characteristics. In accordance with the present invention, images can be fixed by fusing or any other method known to one skilled in the art. In yet another embodiment, this includes a combination of the above.

In one embodiment, a schematic of the photoreceptors, fusers, paper path including inverter/bypass, and stacker of a tandem immediate duplex printer is shown in FIG. 1 for a 16 page (8 sheet) booklet job. Other types of duplex printers known in the art are suitable for use in accordance with the invention. Either a cut sheet or continuous web type can be utilized. The sheets are scheduled to provide a booklet having opposing pages fused the same number of times and developed on the same photoreceptor. The print images are ordered so that opposing faces of pages in the finished booklet are printed by the same photoreceptor or print 'engine'.

Images 1B, 2F, 3B, 4F, 5B, 6F, 7B, and 8F are reverse ordered in a first photoreceptor 11 and printed sequentially on one side of sheets 8 through 1, as shown in FIG. 1. The images and sheets can also be ordered 1 through 8, respectively depending upon preference. Sheets 8 through 1 are fed sequentially to the first photoreceptor 11 along a sheet path 10. Images 1B, 2F, 3B, 4F, 5B, 6F, 7B, and 8F are fused sequentially on respective sheets 1 through 8 by a first fuser 13.

Images IF, 2B, 3F, 4B, 5F, 6B, 7F, and 8B are reverse ordered in a second photoreceptor 12 and printed sequentially on the other side of sheets 8 through 1 along paper path 10, as shown in FIG. 1. Images 1F, 2B, 3F, 4B, 5F, 6B, 7F, and 8B are fused sequentially on respective sheets 1 through 8 by a second fuser 14. In the same instance, images 1B, 2F, 3B, 4F, 5B, 6F, 7B, and 8F are fused sequentially on respective sheets 1 through 8 for a second time by the second fuser 14.

Figure 2:
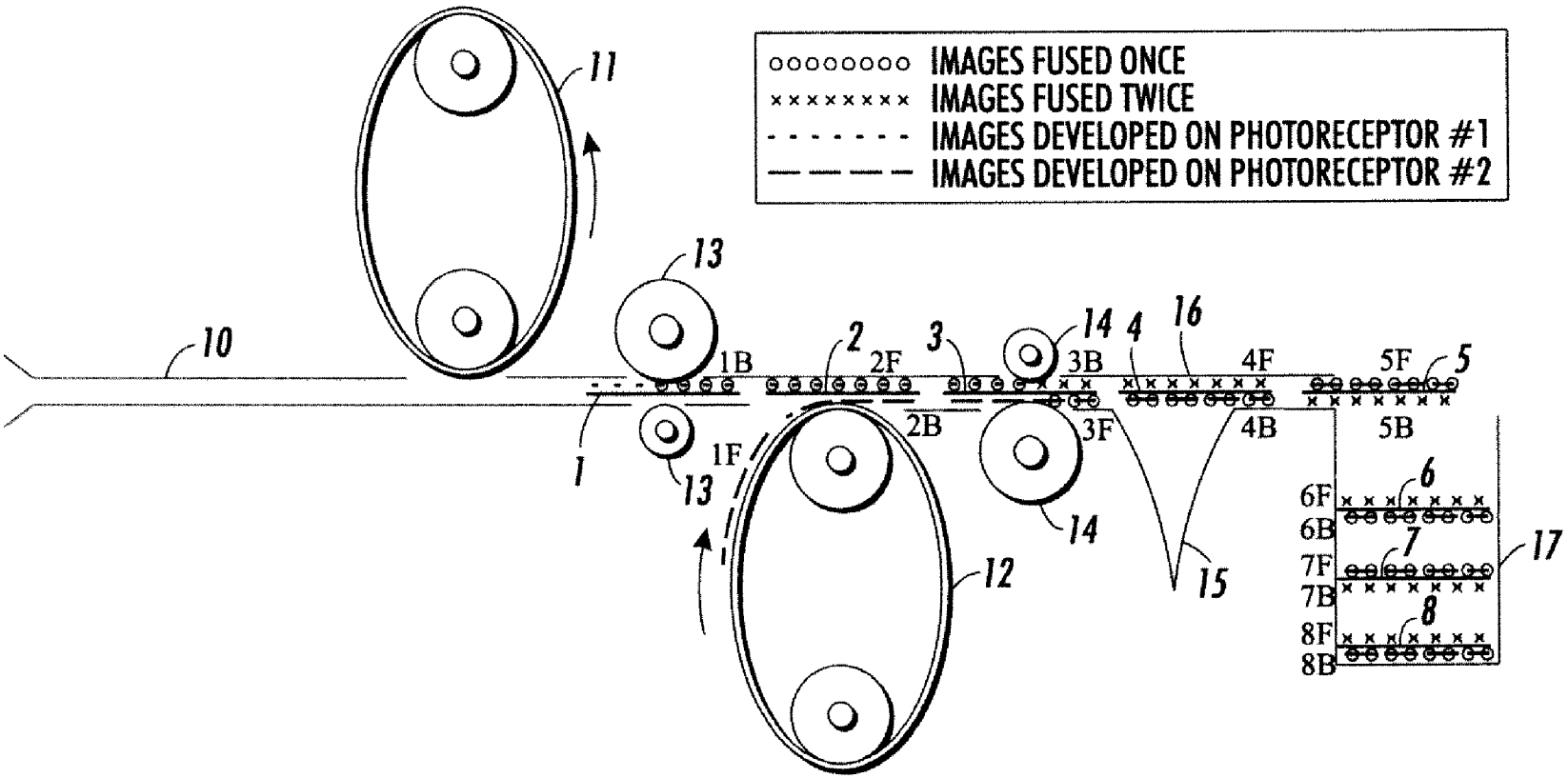
FIG. 2 is a schematic view of the paper path in the tandem duplex printer of FIG. 1 at a later moment.

Odd number sheets 1, 3, 5, and 7 are inverted by an inverter 15 prior to entering a stacker 17. Even number sheets 2, 4, 6, and 8 skip inverter 15 and enter stacker 17 through a bypass 16. The inverter 15/bypass 16 are located along paper path 10 between the second fuser 14 and the stacker 17. In this manner, images fused once are placed on pages that are destined as opposing pages of the finished booklet, such as 6B and 7F, and images fused twice are placed on pages that are destined as opposing pages of the booklet, such as 7B and 8F, as shown in FIG. 2, Moreover, images on opposing pages 6B and 7F are developed on the second photoreceptor 12, and images on opposing pages 7B and 8F are developed on the first photoreceptor 11, as shown in FIG. 2.

Figure 3:
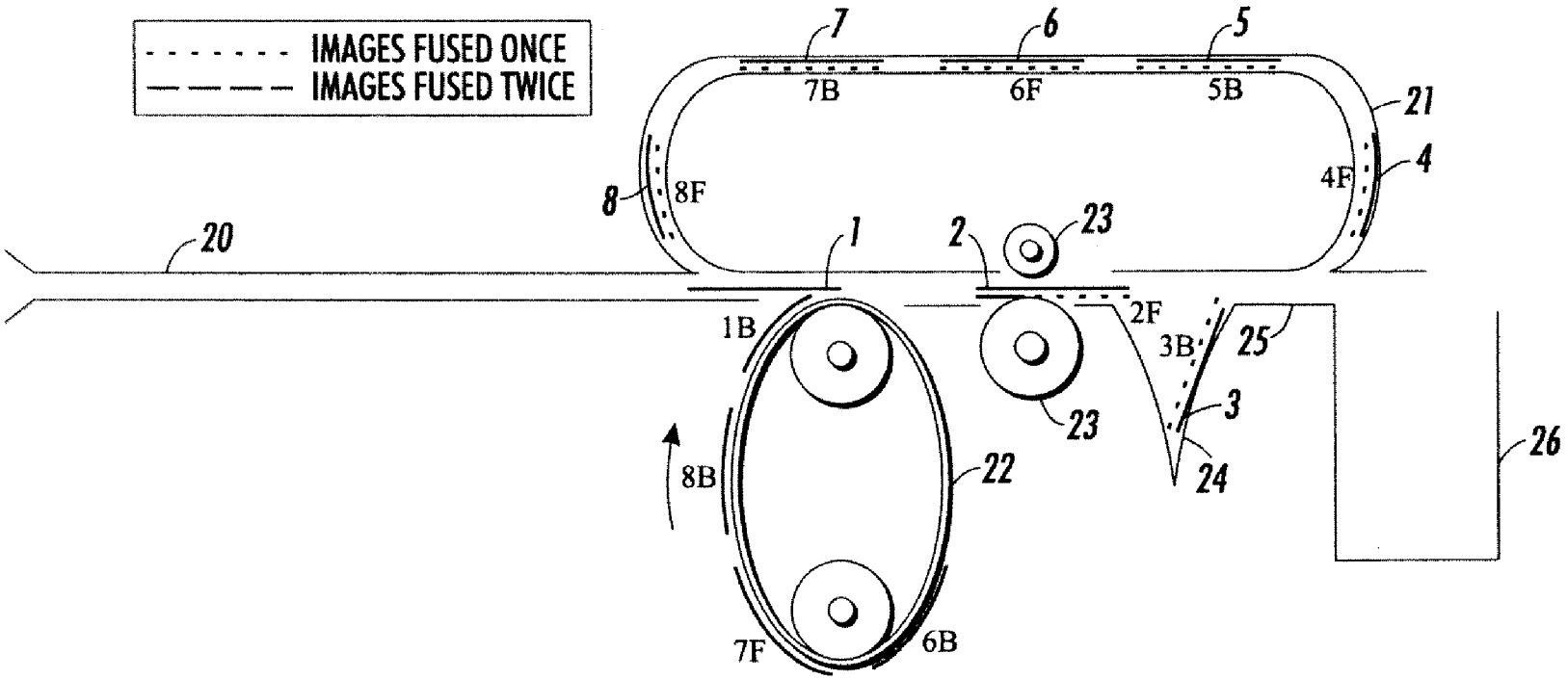
FIG. 3 is a schematic view of the paper path in a recirculating duplex printer in accordance with another embodiment.

In another embodiment, a schematic of the photoreceptor, fuser, paper path including inverter/bypass, and stacker of a recirculating duplex printer is shown in FIG. 3 for a 16 page (8 sheet) booklet job. Other types of recirculating duplex printers known in the art are suitable for use in accordance with the invention. Either a cut sheet or continuous web type can be utilized. The sheets are scheduled to provide a booklet having opposing pages fused the same number of times.

The print images are ordered so that opposing faces of pages in the finished booklet are fused the same number of times. A recirculating printer typically utilizes one photoreceptor or print "engine" so that the opposing faces of pages in the finished booklet are all printed by the same photoreceptor. Images 1B, 2F, 3B, 4F, 5B, 6F, 7B, and 8F are reverse ordered in a photoreceptor 22 and printed sequentially on one side of sheets 8 through 1, as shown in FIG. 3. The images and sheets can also be ordered 1 through 8, respectively depending upon preference. Sheets 8 through 1 are fed sequentially to the photoreceptor 22 along a sheet path 20. Images 1B, 2F, 3B, 4F, 5B, 6F, 7B, and 8F are fused sequentially on respective sheets 1 through 8 by the fuser 23.

Figure 4:
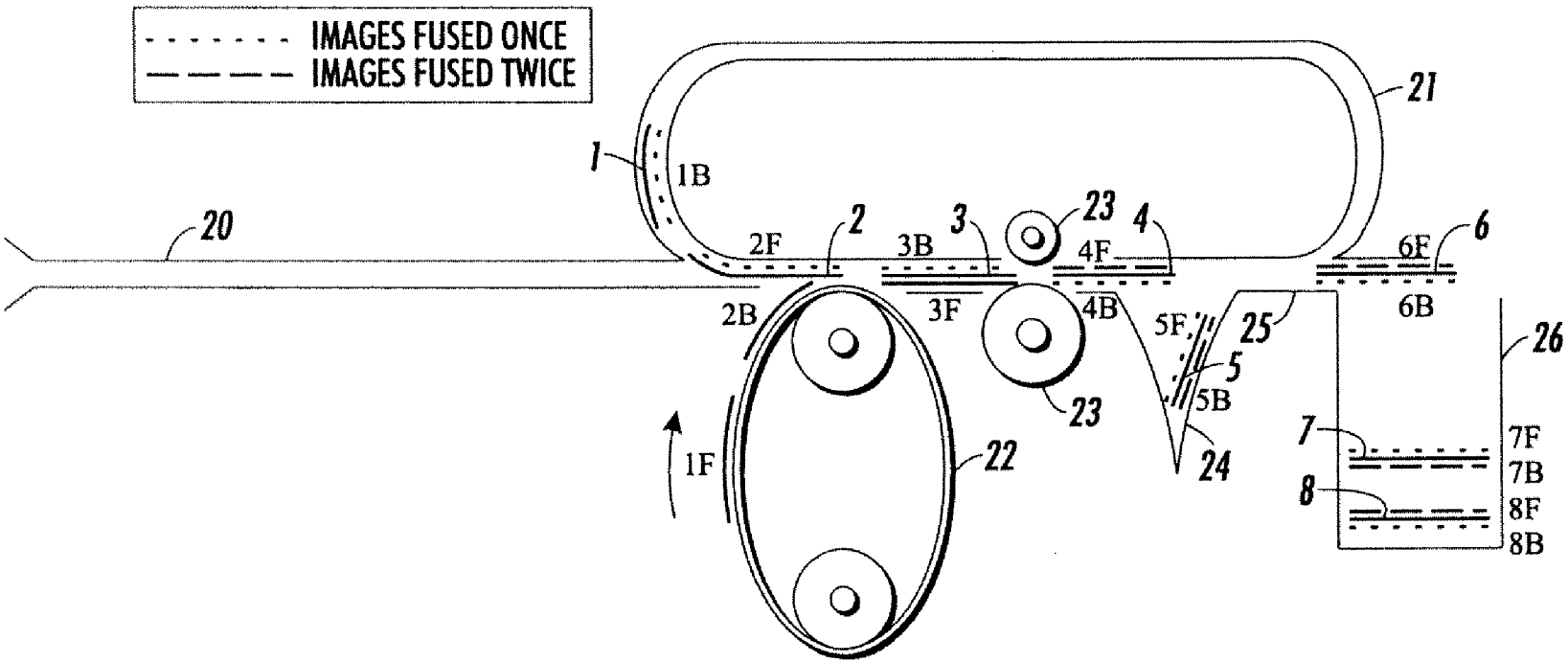
FIG. 4 is a schematic view of the paper path in the recirculating duplex printer of FIG. 3 at a later moment.

AH sheets 1 through 8 are inverted by an inverter 24 on their first pass prior to being recirculated through the printer 21. Images 1F, 2B, 3F, 4B, 5F, 6B, 7F, and 8B are reverse ordered in the photoreceptor 22 and printed sequentially on the other side of sheets 8 through 1 which are recirculating through printer 21, as shown in FIG. 4. Images 1F, 2B, 3F, 4B, 5F, 6B, 7F, and 8B are fused sequentially on respective sheets 1 through 8 by the fuser 23. In the same instance, images 1B, 2F, 3B, 4F, 5B, 6F, 7B, and 8F are fused sequentially on the other side of respective sheets 1 through 8 for a second time by the fuser 23.

As shown in FIG. 4, odd numbered sheets 1, 3, 5, and 7 are inverted by inverter 24 on their second pass prior to entering a stacker 26. Even number sheets 2, 4, 6, and 8 skip inverter 24 and enter stacker 26 through a bypass 25. The inverter 24/bypass 25 is located along paper path 10 between the fuser 23 and the stacker 26. In this manner, images fused once are placed on pages that are destined as opposing pages of the finished booklet, such as 6B and 7F, and images fused twice are placed on pages that are destined as opposing pages of the booklet, such as 7B and 8F, as shown in FIG. 4. Since the recirculating printer 21 utilizes one photoreceptor 22, the opposing faces of pages in the finished booklet are all printed by the same photoreceptor.

Suitable printer devices of the present invention include photoreceptors and direct marking printers, such as ink jet, solid ink jet, and thermal ink jet printers. When fixing an image to the sheet using a direct marking printer the method for producing a booklet from a multiple engine serial duplex printer, includes:

ordering sequentially a first plurality of images on a first printing device;

feeding sequentially a plurality of two-sided sheets to the first printing device;

printing sequentially on one side of each of the plurality of two-sided sheets a corresponding one of the first plurality of images;

ordering sequentially a second plurality of images on a second printing device, such that when the second plurality of images is sequentially printed on a corresponding one of the other side of each of the plurality of two-sided sheets and alternate sheets in the sequence are inverted and stacked with alternate non-inverted sheets, images on opposing sides of the sheets are printed by the same printing device;

feeding sequentially the plurality of two-sided sheets to the second printing device;

printing sequentially on the other side of each of the plurality of two-sided sheets a corresponding one of the second plurality of images;

inverting alternated ones of the plurality of two-sided imaged sheets; and stacking sequentially the inverted sheets and non-inverted sheets, so that images on opposing sides of the sheets are printed by the same printing device.

Other modifications of the present invention may occur to those skilled in the art subsequent to a review of the present application, and these modifications, including equivalents thereof, are intended to be included within the scope of the present invention.

What is claimed is:

1. A system for producing a booklet, comprising:

a sorting component that sequentially orders a first plurality of images and a second plurality of images;

a feeder that sequentially feeds a plurality of two-sided sheets;

a first printing device that sequentially prints one of the first plurality of images on a first side of each of the plurality of two-sided sheets;

a second printing device that sequentially prints one of the second plurality of images on a second side of each of the plurality of two-sided sheets;

an inverter that alternately inverts the plurality of two-sided imaged sheets; and a stacker that sequentially stacks the inverted and non-inverted sheets so that images on opposing sides are printed by the same printing device, the plurality of two-sided sheets with images are used to produce a booklet in which a plurality of pages of the booklet each have an image printed thereon and each image has been printed by a same printing device as the image on an opposing page.

2. The system according to claim 1, further including at least one more printing devices.

3. The system according to claim 1, wherein at least one of the first and the second printing devices includes a photoreceptor.

4. The system according to claim 1, wherein at least one of the first and the second printing engines prints via a direct marking process.

5. The system according to claim 4, wherein at least one of the first and the second printing engines includes an ink jet, a solid ink jet, and a thermal ink jet printer.

6. The system according to claim 1, further including a first fixer that fixes the image printed by the first printing device on the first side of each of the plurality of two-sided sheets.

7. The system according to claim 6, further including a second fixer that subsequently fixes the image printed by the second printing device on the second side of each of the plurality of two-sided sheets, the second fuser concurrently fixes the image printed by the first printing device on the first side of each of the plurality of two-sided sheets.

8. The system according to claim 7, wherein images on opposing pages of the booklet have been subject to a fixing process a same number of times.

9. The system according to claim 1, wherein the first and the second printing devices form a multiple engine serial duplex printer.

10. A xerographic system for producing a booklet, comprising a sorting component that sequentially orders a first plurality of images and a second plurality of images;

a feeder that sequentially feeds a plurality of two-sided sheets;

a first printing device that sequentially transfers one of the first plurality of images on a first side of each of the plurality of two-sided sheets;

a first fixer that fixes the image transferred to the first side of the plurality of two-sided sheets;

a second printing device that sequentially transfers one of the second plurality of images on a second side of each of the plurality of two-sided sheets; wherein a second fixer fixes images transferred to the second side on each of the plurality of two-sided sheets while concurrently fixing the image transferred to the first side of the plurality of two-sided sheets a second time; an inverter that alternately inverts the plurality of two-sided imaged sheets; and a stacker that sequentially stacks the alternately inverted and non-inverted sheets, the plurality of two-sided sheets with images are used to produce a booklet in which a plurality of pages of the booklet each have an image contained thereon and each image has been subject to a fixing process a same number of times as the image on an opposing page and each image has been printed by a same printing device as the image on an opposing page.

11. The xerographic system according to claim 10, wherein at least one of the first and the second printing devices is part of a multiple engine serial duplex printer.

* * * * *